US010589899B2

(12) United States Patent
Pantelleria

(10) Patent No.: US 10,589,899 B2
(45) Date of Patent: Mar. 17, 2020

(54) TAPERED-WALL FOUR CORNER TRAY

(71) Applicant: Huhtamaki, Inc., De Soto, KS (US)

(72) Inventor: Joseph A. Pantelleria, Overland Park, KS (US)

(73) Assignee: HUHTAMAKI, INC., De Soto, KS (US)

( * ) Notice: Subject to any disclaimer, the term of this patent is extended or adjusted under 35 U.S.C. 154(b) by 15 days.

(21) Appl. No.: 15/806,207

(22) Filed: Nov. 7, 2017

(65) Prior Publication Data

US 2018/0127151 A1 May 10, 2018

Related U.S. Application Data

(60) Provisional application No. 62/418,590, filed on Nov. 7, 2016.

(51) Int. Cl.

| | |
|---|---|
| ***B65D 21/02*** | (2006.01) |
| ***B65D 5/30*** | (2006.01) |
| ***B65D 5/36*** | (2006.01) |
| ***B65D 5/66*** | (2006.01) |

(52) U.S. Cl.

CPC ..... *B65D 21/0233* (2013.01); *B65D 5/302* (2013.01); *B65D 5/3642* (2013.01); *B65D 5/6626* (2013.01)

(58) Field of Classification Search

CPC .. B65D 21/0233; B65D 5/302; B65D 5/3642; B65D 5/6626

See application file for complete search history.

(56) References Cited

U.S. PATENT DOCUMENTS

| | | | | | |
|---|---|---|---|---|---|
| 1,271,033 | A * | 7/1918 | Hall | B65D 5/248 | 229/116 |
| 1,463,448 | A * | 7/1923 | Stern | B65D 5/302 | 229/197 |
| 2,008,935 | A * | 7/1935 | Stern | B65D 5/302 | 229/117.07 |
| 2,605,955 | A * | 8/1952 | Meller | B65D 5/302 | 229/196 |
| 2,889,102 | A * | 6/1959 | Wagaman | B65D 5/247 | 229/188 |
| 3,069,061 | A * | 12/1962 | Dion | B65D 5/302 | 229/195 |
| 3,450,330 | A * | 6/1969 | Pierce, Jr. | B65D 5/247 | 229/154 |
| 3,481,525 | A * | 12/1969 | Pierce, Jr. | B65D 5/26 | 229/194 |
| 3,734,391 | A * | 5/1973 | Manizza | B65D 5/302 | 229/117.07 |
| 4,105,155 | A | 8/1978 | Forbes, Jr. | | |
| 4,362,266 | A | 12/1982 | Webinger | | |
| 4,498,585 | A | 2/1985 | Gordon et al. | | |
| 6,116,498 | A | 9/2000 | Sheffer | | |

(Continued)

*Primary Examiner* — Corey N Skurdal
(74) *Attorney, Agent, or Firm* — Husch Blackwell LLP

(57) ABSTRACT

A foldable tray with stable side walls and tapered walls for convenient stacking is provided. The tray may include two outward tapered walls and two straight walls. The side walls are reinforced or stabilized by providing an interlocking end flap tab inserted through a cut line in the side wall. The tray may also include a hinged lid to form a hinged box. The lid may include an inwardly tapering wall to accommodate and overlay one of the outwardly tapering walls of the tray.

26 Claims, 13 Drawing Sheets

(56) References Cited

U.S. PATENT DOCUMENTS

| | | | | |
|---|---|---|---|---|
| 6,505,769 | B2 * | 1/2003 | Stone | B65D 5/2047<br>229/125.35 |
| 2010/0178396 | A1 * | 7/2010 | Lafferty | A47J 27/088<br>426/243 |

* cited by examiner

TAPERED-WALL FOUR CORNER TRAY

CROSS-REFERENCE TO RELATED APPLICATIONS

This application claims priority to U.S. Provisional Patent Application No. 62/418,590, which was filed on Nov. 7, 2016, and which is incorporated herein in its entirety.

BACKGROUND

Foldable trays and containers are commonly used in the quick-service food industries as well as various other industries as vessels for holding, transporting and storing food and other items. Such trays are commonly constructed from a flat blank and folded into a tray having a sidewall. One problem with known trays is that once they are folded into shape and the sidewall flaps are glued or otherwise connected together to form the tray sidewall, the trays are difficult to stack and nest together and/or become stuck together once stacked. This is a result of the general vertical shape of the tray sidewalls, which extend generally perpendicular to the bottom of the tray. As a result, many quick-service food providers leave the tray blanks in their folded state until ready for use and must spend time constructing the trays.

An additional problem with known foldable trays and containers is that due to their foldable/collapsible construction, the tray sidewalls are weakened along fold lines and can fail to maintain their upright configuration after unfolding. As a result, food and other items can easily fall out of the trays, the sidewall can inadvertently collapse, and the trays can be easily deformed and difficult to hold and carry.

Accordingly, a need exists for a foldable tray that can be formed from a unitary blank and easily and compactly stacked together with other similar trays after formation. Additionally, a need exists for a foldable tray that can be configured from a folded state and maintain sufficient form and rigidity after formation.

SUMMARY

The present application is directed to a foldable stackable tray with tapered and stable walls (the "tray") assembled from a foldable blank. In one aspect, the tray is combined with a foldable lid to form a foldable stackable box, where the tray portion may be referred to as "the base" or "the base tray", and the lid portion as "the lid." In a particular embodiment, the lid is a piece separate from the base tray that is assembled from a blank that is discontinuous to the blank for the base tray. In another particular embodiment, the lid is connected to the base by a hinge line to form a hinged box.

In one embodiment, the base tray of the hinged box includes a bottom panel, and two side wall panels, a front wall panel, and a back wall panel that articulates with the lid (collectively "wall panels"). In a specific embodiment, one or both of the front panel and the back panel subtends a fixed angle of greater than 90° with the bottom panel to form outwardly tapering tapered walls 12. The tapered walls enable easy nested stacking of the unfolded trays. In one embodiment, each side panel subtends a fixed angle of about 90° with the bottom panel to form straight walls to accommodate the side panels of the lid.

In one embodiment, the lid of the hinged box includes a top panel, two side panels, and a front panel (collectively "top wall panels"). Each of the side panels subtend a fixed angle of about 90° with the top panel to form straight walls to accommodate the straight walls of the base. In a specific embodiment, the front panel subtends a fixed angle of less than 90° with the top panel to form an inwardly tapering wall of the lid that accommodates the outwardly tapering wall of the base tray. In one embodiment, the top panel and the bottom panel are each rectangular with the first dimension having about the same length in common and the second dimension having different lengths between the top panel and bottom panel. In a particular embodiment, the second dimension of the top panel is longer than the second dimension of the bottom panel to permit the front panel of lid to overlap front panel of the base tray when the lid is in the closed position.

In one embodiment, the side panels of the base tray of the hinged box are stabilized in the unfolded upright state by securing at least one fold flap fold line on the side panel to prevent the side panel from easily collapsing inwardly toward the bottom panel. In one embodiment, the fold flap fold line is secured by inserting the lower corner of an end flap through a cut in a side panel. In a more specific embodiment, the base includes a cut proximal to each end flap, and the lower corner of each end flap is inserted into its respective cut. In one embodiment, the side panel cut can be of any shape, as long as it accommodates the lower corner of the end flap. In a specific embodiment, the cut is curved or includes one or more angles (collectively "rounded cut") to more easily open when slight outward pressure is applied to the end flaps.

In another embodiment, the lid side panels of the lid of the hinged box are stabilized in the unfolded position by securing the bottom edge of the flap against the top panel. In one embodiment, the flap is shaped and fixed to a triangular fold flap of the lid side panel to frictionally bind the bottom edge of the flap against the inner surface of the top panel when the lid is unfolded.

In one aspect, a single unfolded blank is provided for any one or more embodiments of the hinged box of the previous aspect.

In another aspect, the foldable stackable tray ("the tray") is without a lid. In one embodiment, the foldable stackable tray includes a bottom panel, two side panels, and two end panels. In one embodiment, each of the side panels, each of the end panels, or each of the side panels and end panels together subtend a fixed angle of greater than 90° with the bottom panel to form one or more outwardly tapering tapered walls in the unfolded tray. In a specific embodiment, each end panel subtends a fixed angle of greater than 90° with the bottom panel to form outwardly tapering tapered walls, and each side panel subtends a fixed angle of about 90° with the bottom panel to form straight walls. The tapered walls enable easy nested stacking of the unfolded trays.

In one embodiment, any one or more of the side panels and the end panels of the tray 10 are stabilized in the unfolded upright state by securing at least one fold flap fold line on the side panel or on the end panel to prevent or reduce the likelihood of the side panel or the end panel inadvertently collapsing toward the bottom panel. In one embodiment, the fold flap fold line is reinforced by inserting the lower corner of a flap through a cut in a side panel or in an end panel. In a specific embodiment, tray includes two cuts on each side panel proximal to each end flap, and the lower corner of each end flap is inserted into its respective cut. In one embodiment, the side panel cut can be of any shape, as long as it accommodates the lower corner of the end flap. In a specific embodiment, the cut is curved or includes one or more angles (collectively "rounded cut") to more easily open when slight outward pressure is applied to the end flaps.

In one aspect, a single unfolded blank is provided for any one or more embodiments of the foldable stackable trays of the previous aspect.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION

Figure 1:
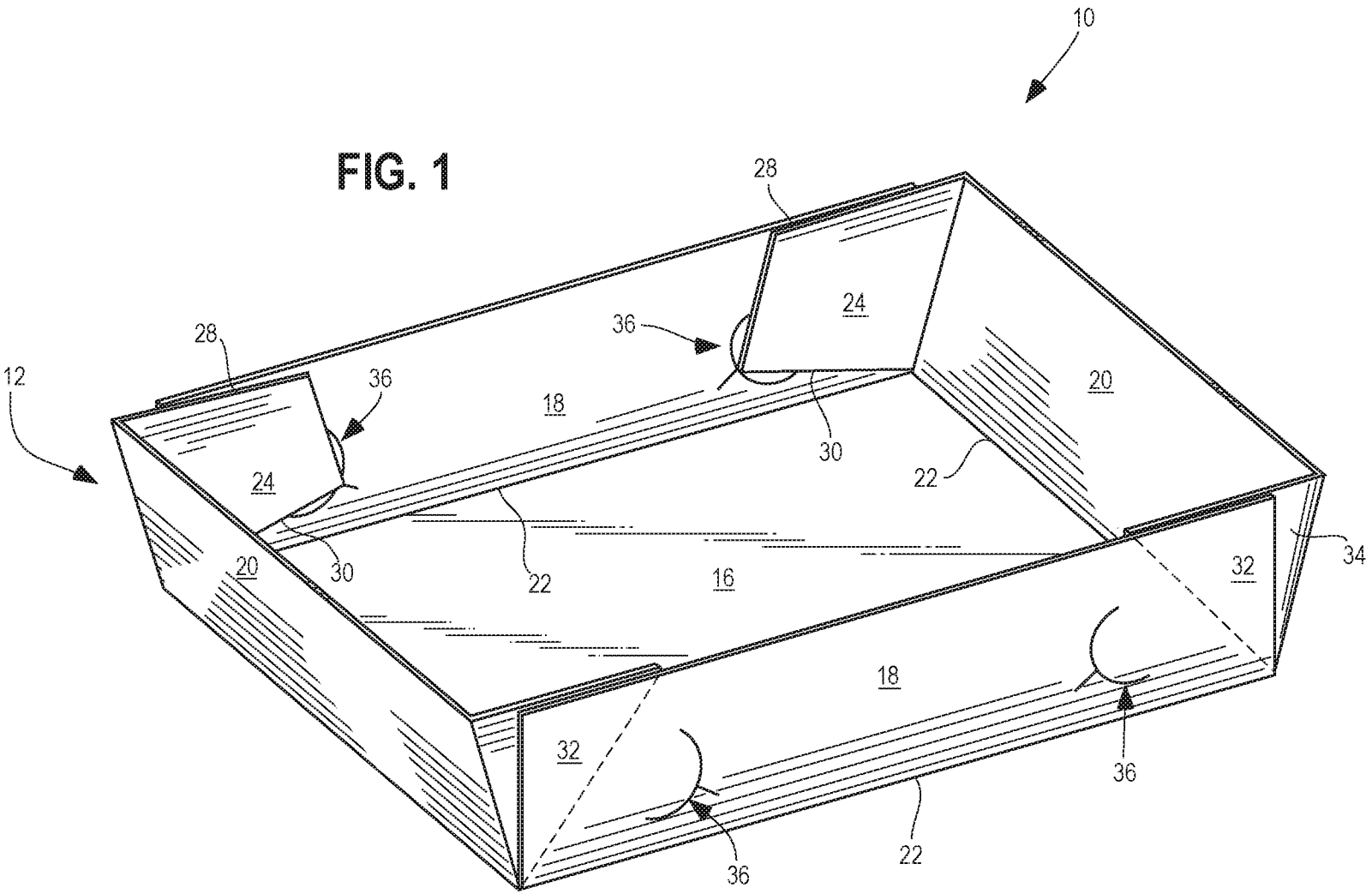
FIG. 1 is a perspective view of a foldable tray in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be used and changes can be made without departing from the scope of the present invention. The present invention is defined by the appended claims and the description is, therefore, not to be taken in a limiting sense and shall not limit the scope of equivalents to which the claims are entitled.

Figure 8:
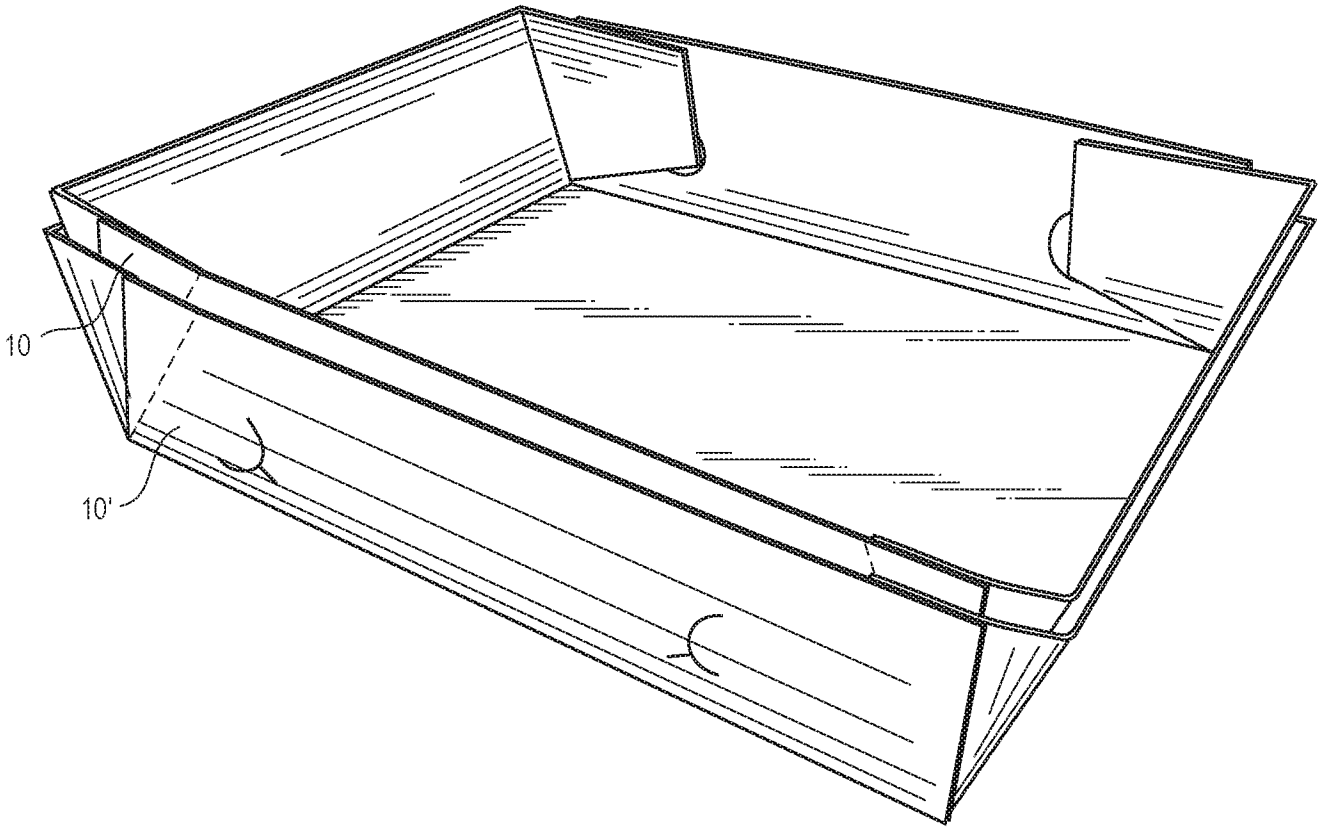
FIG. 8 is a perspective view of two foldable trays stacked together in accordance with one embodiment of the present invention.

The present invention is generally directed toward a carton or tray 10 as shown for example in FIG. 1 having one or more tapered walls 12 and configured to allow stacking and nesting of a plurality of trays 10 in a convenient and compact manner for example as depicted in FIG. 8. Tray 10 can be constructed from any planar and rigid material such as paperboard, cardboard, plastic, or other like suitable material, and can be formed from a blank 14 as shown and described herein.

Figure 2:
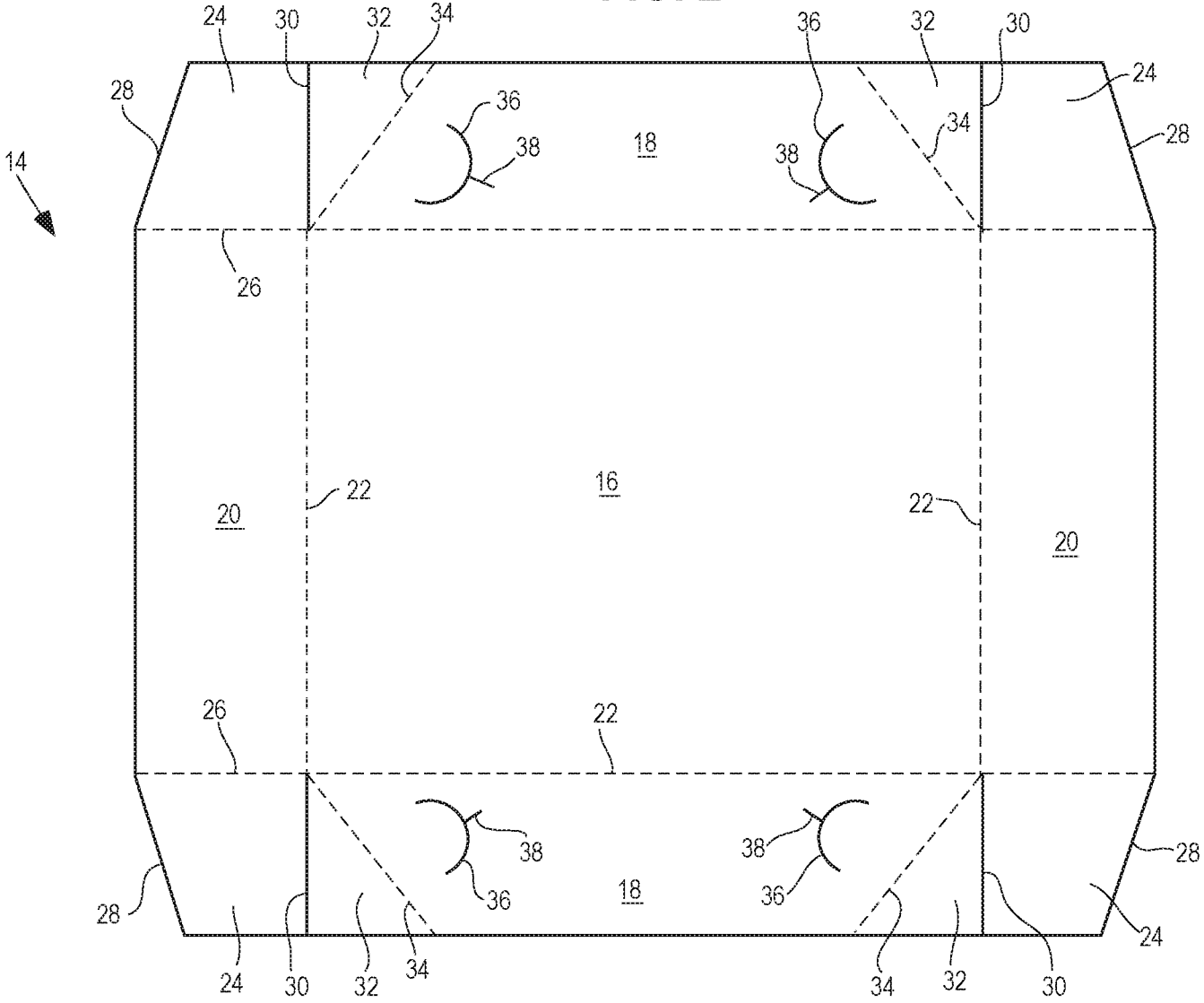
FIG. 2 is a plan view of a blank for a foldable tray in accordance with one embodiment of the present invention.

In one embodiment as shown in FIG. 2, tray 10 (and blank 14) can include a plurality of foldable panels, including a bottom panel 16, first and second side panels 18, and first and second end panels 20. Each side panel 18 and end panel 20 can be foldably connected to bottom panel 16 by a fold line 22. According to one or more embodiments, the creation of fold lines 22 can be facilitated by the use of score lines, perforated lines, or compressed lines (together "machine lines") along each fold line 22. Such machine lines may be disposed on the foldable blank during manufacturing and allow the carton to be easily folded at those locations. Panels 18 and 20 can be connected to bottom panel 16 along each edge of bottom panel 16. For example, side panels 18 can be connected on two of the opposing edges of bottom panel 16 while end panels 20 can be connected to the two remaining opposing edges of bottom panel 16. In order to form tray 10 from blank 14, each side panel 18 can be folded upward into a generally perpendicular orientation and each end panel 20 can be folded upward into a generally upright and outwardly tapering tapered orientation in order to form tapered walls 12 as illustrated in FIG. 1 and described further below.

As further shown in FIG. 2, in one embodiment, each end panel 20 can include a pair of end flaps 24 positioned along the side edges of each end panel 20. Each end flap 24 can be foldably connected to the side edge of end panel 20 by a fold line 26. In one embodiment, one or more end flaps 24 can include a tapered edge 28 extending from end flap fold line 26 toward the terminal edge of end flap 24. As shown in FIG. 2, the tapered edge 28 can have a slightly angled orientation relative to the terminal edge of end panel 20. The slightly angled orientation of the tapered edge 28 can help in creating the greater than 90° fixed angle of the outward tapering tapered wall 12. End flaps 24 can also include a cut edge 30 opposite tapered edge 28. Cut edge 30 can be cut away from or otherwise disconnected from the edge of corresponding side panel 18 positioned adjacent to end flap 24, which facilitates the folding of end flaps 24 and their independent movement relative to side panels 18.

As also shown in FIG. 2, each side panel 18 can include a pair of triangular fold flaps 32 positioned along the sides of each side panel 18. As shown in FIG. 2, triangular fold flaps 32 can be formed by a fold flap fold line 34 extending in a general inward angled direction from side panel fold line 22. Fold flap fold lines 34 enable the folding of the side panels 18 and end panels 20 toward the bottom panel 16 while the assembled tray 10 is folded.

In one embodiment, each side panel 18 can further include a pair of cuts 36 configured for allowing a distal end or corner 70 of a corresponding end flap 24 to be partially inserted therethrough when configuring tray 10 as described below. Insertion of the distal end or corner 70 into the cut 36 enables end flap 24 to provide lateral support along fold flap fold line 34 to prevent the inadvertent inward folding of the side panels 18 toward the bottom panel 16 when the tray 10 is unfolded. In order to facilitate the partial insertion of end flap 24 through cut 36, in one embodiment each cut 36 can have an insert slit 38 extending away from cut 36 as shown in FIG. 2, for example. While cuts 36 are described and shown in the figures as being rounded cuts, it will be appreciated that cuts 36 may be of any suitable size, shape, configuration or orientation, including but not limited to, straight, linear, angled, curved, or arcuate for example, and may be comprised of a single cut or multiple connected cuts.

In one embodiment, blank 14 can be a unitary blank and can be cut from a larger sheet or roll of material in a die-stamping process. During the production process of blank 14, one or more of fold lines 22, 26 and 34 can be scored, perforated, compressed or otherwise weakened to facilitate the folding of blank 14 during the configuration of tray 10. In addition, end flaps 24 can be cut from side panels 18 along end flap cut edges 30 as described above.

As shown in FIG. 1, blank 14 can be configured into tray 10 by folding side panels 18 into an upright, generally perpendicular orientation (i.e., about 90°) relative to bottom panel 16, and folding end panels 20 into a generally upright and slightly tapered or angled orientation (i.e., greater than 90°) relative to bottom panel 16 in order to form outwardly tapering tapered walls 12. In one embodiment as shown in FIG. 1, each end flap 24 of both end panels 20 can be folded inward adjacent to the interior of its corresponding adjacent side panel 18. Due to the tapered configuration of end panels 20 (and tapered walls 12), in one embodiment, a portion of end flaps 24 can remain visible from the exterior of tray 10. The tapered edge 28 of each end flap 24 can allow each end flap 24 to remain below the upper edge of the corresponding side panel 18 even though each end flap 24 is orientated at an angle relative to side panels 18 in order to create tapered walls 12.

Each end flap 24 can also be secured to the adjacent side panel fold flap 32 by means of an adhesive such as e.g., a latex glue, a polyvinyl acetate glue, an epoxy, a polyurethane, a rubber cement, a cyanoacrylate adhesive, and the like; heat sealing, such as e.g., polypropylene or other polymer, wax, and the like; mechanical fixing, such as e.g., brads, rivets, pins, staples, and the like; or other suitable means. According to one embodiment of the present invention, a small bead of adhesive is applied to a portion of the interior side of side panel fold flap 32 and end flap 24 is then placed in the correct orientation to form tapered wall 12 and the exterior side of end flap 24 is secured to side panel fold flap 32.

Figure 3A:
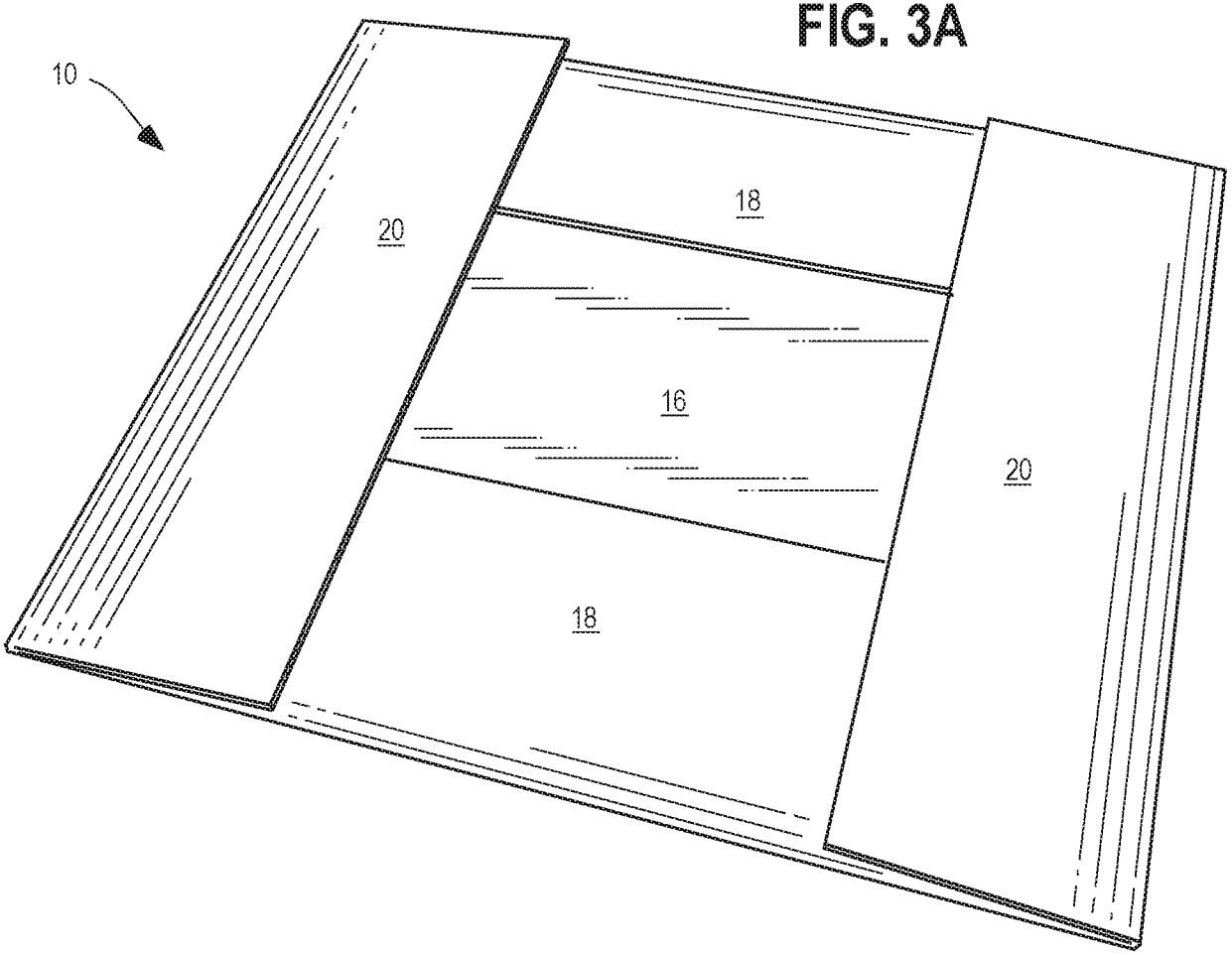
FIG. 3A is a perspective view of a foldable tray illustrating the foldable tray in a folded position in accordance with one embodiment of the present invention.
Figure 3B:
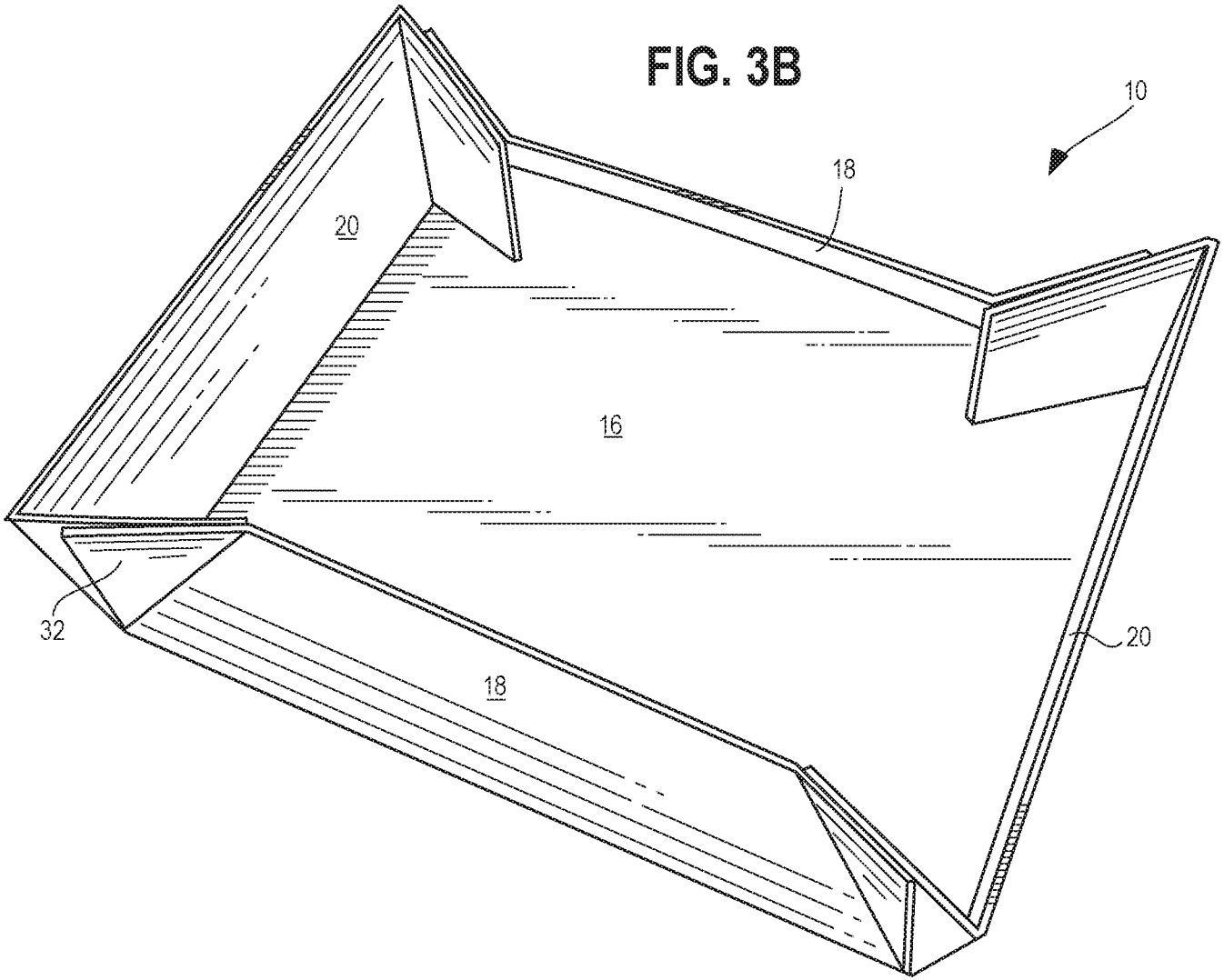
FIG. 3B is a perspective view of the foldable tray of FIG. 3A illustrating the foldable tray partially transitioned between the folded position and an upright position in accordance with one embodiment of the present invention.
Figure 3C:
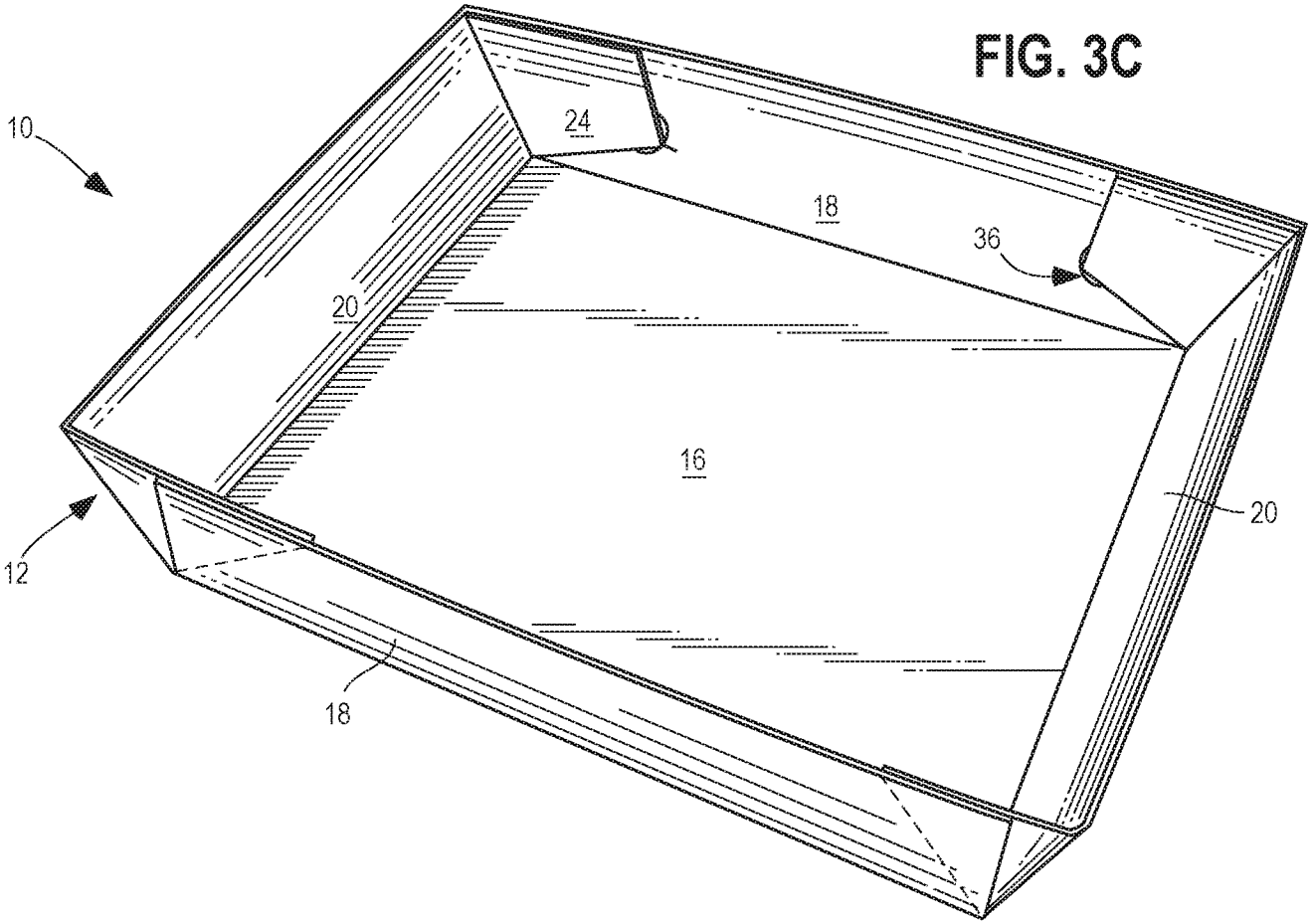
FIG. 3C is a perspective view of the foldable tray of FIG. 3A illustrating the foldable tray configured in an upright position in accordance with one embodiment of the present invention.
Figure 4:
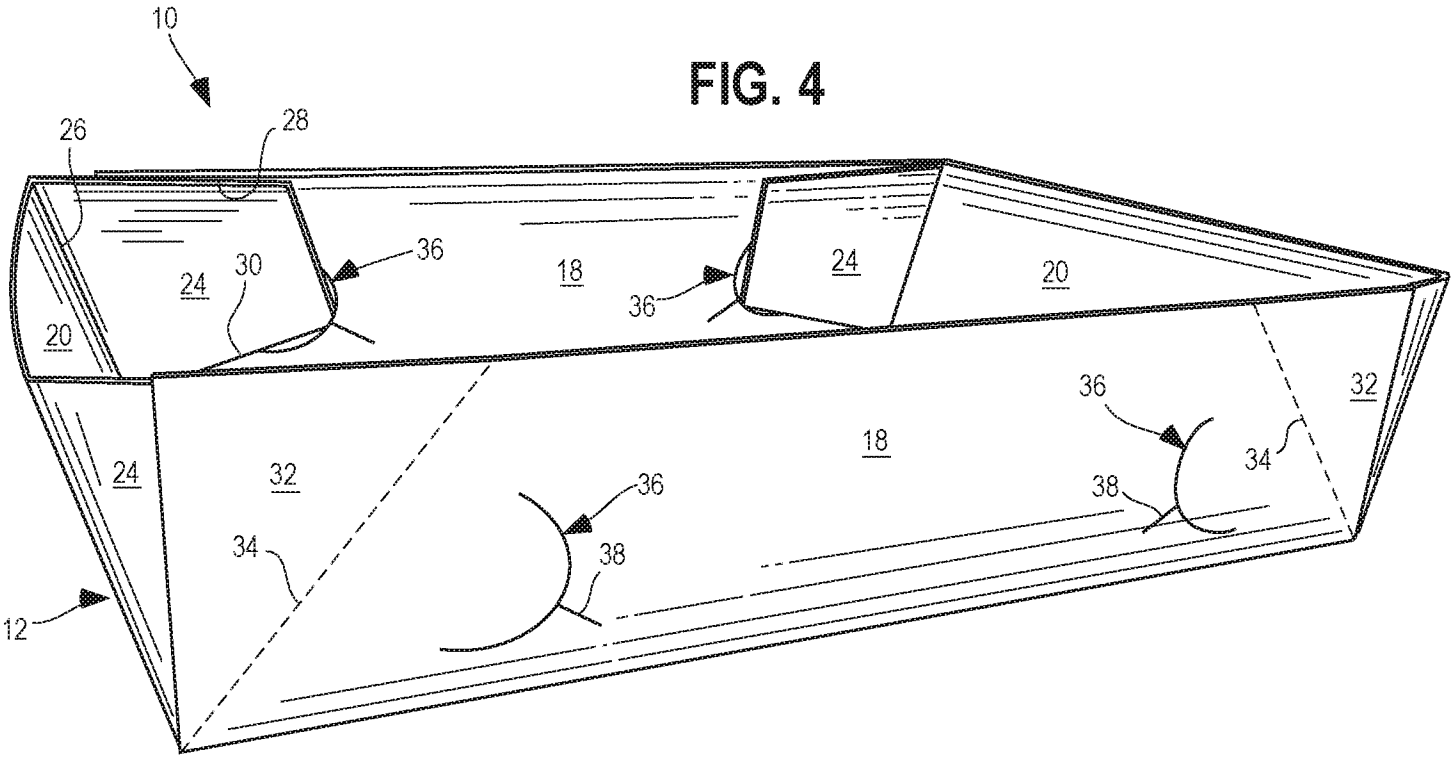
FIG. 4 is a side perspective view of a foldable tray in accordance with one embodiment of the present invention.
Figure 5:
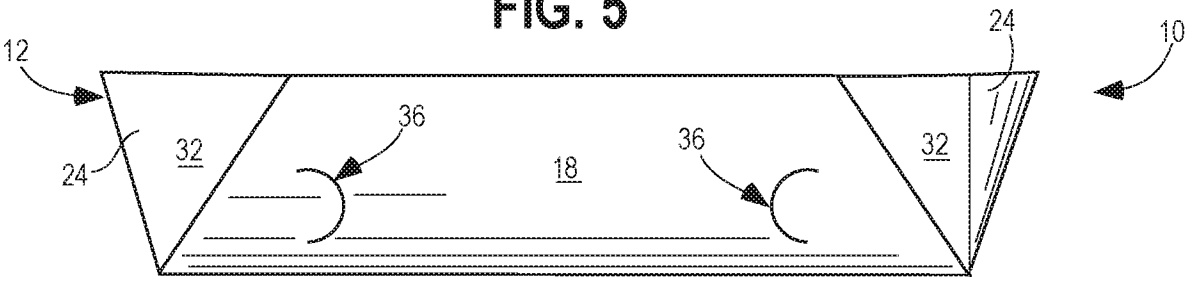
FIG. 5 is a side elevation view of the foldable tray of FIG. 4.
Figure 6:
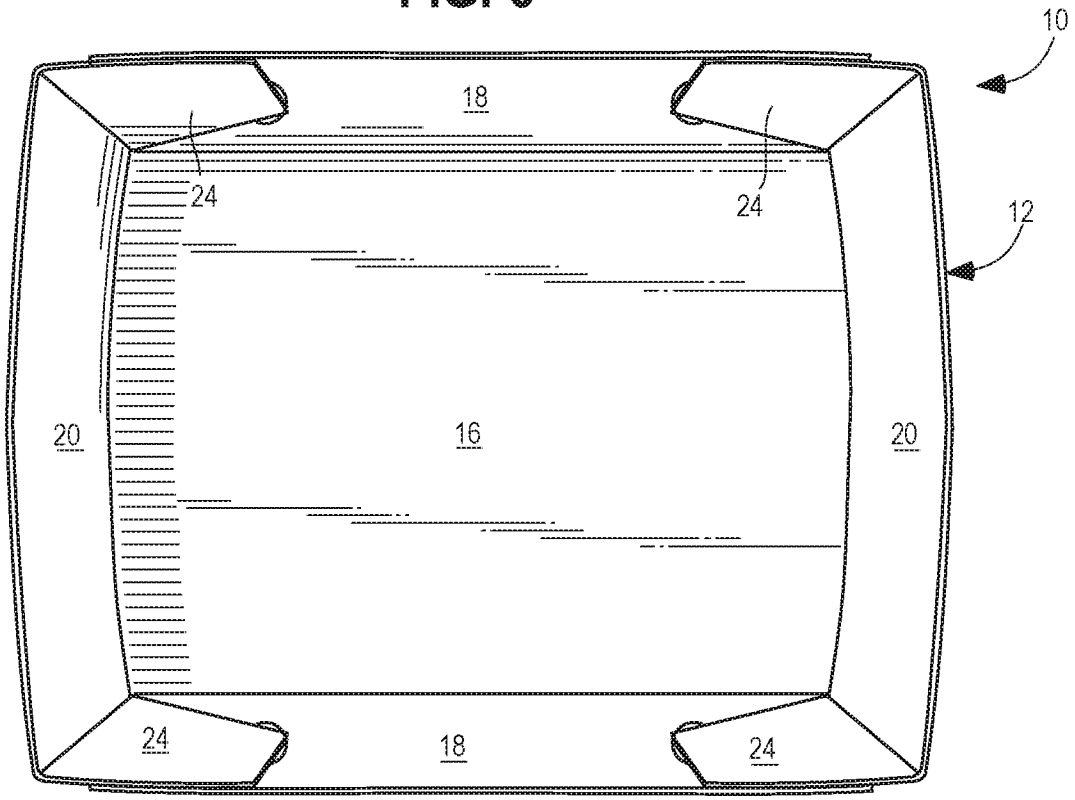
FIG. 6 is a top plan view of the foldable tray of FIG. 4.

The tapered configuration of end panels 20 and corresponding end flaps 24 along with side panel fold flaps 32 allow tray 10 to transition between a upright position (aka "unfolded") (as illustrated in FIG. 1) and a collapsed position (aka "folded") (as illustrated in FIG. 3A). In one embodiment, to place tray 10 into the collapsed position, side panels 18 can be folded inward toward bottom panel 16. Side panel fold flaps 32 allow side panels 18 to begin to fold inward while end panels 20 remain generally upright, as shown in FIG. 3B, even though end flaps 24 are affixed to fold flaps 32 of side panels 18. As side panels 18 fold inward, side panel fold flaps 32 can fold outwardly along fold flap fold line 34 and against the exterior side of side panels 18. End flaps 24 can then fold onto the exterior side of side panels 18 and side panel fold flaps 32, and finally end panels 20 can fold onto end flaps 24 as illustrated in FIG. 3A. This configuration can allow for efficient and economical shipping, transport and storage. FIGS. 3A-3C illustrate the transition process of tray 10 being unfolded from the collapsed (folded) position into the upright (unfolded) position. Conversely, viewing the figures in reverse from FIG. 3C-3A illustrates the transition process of tray 10 being folding into the collapsed (folded) position from the upright (unfolded) position.

Figure 7:
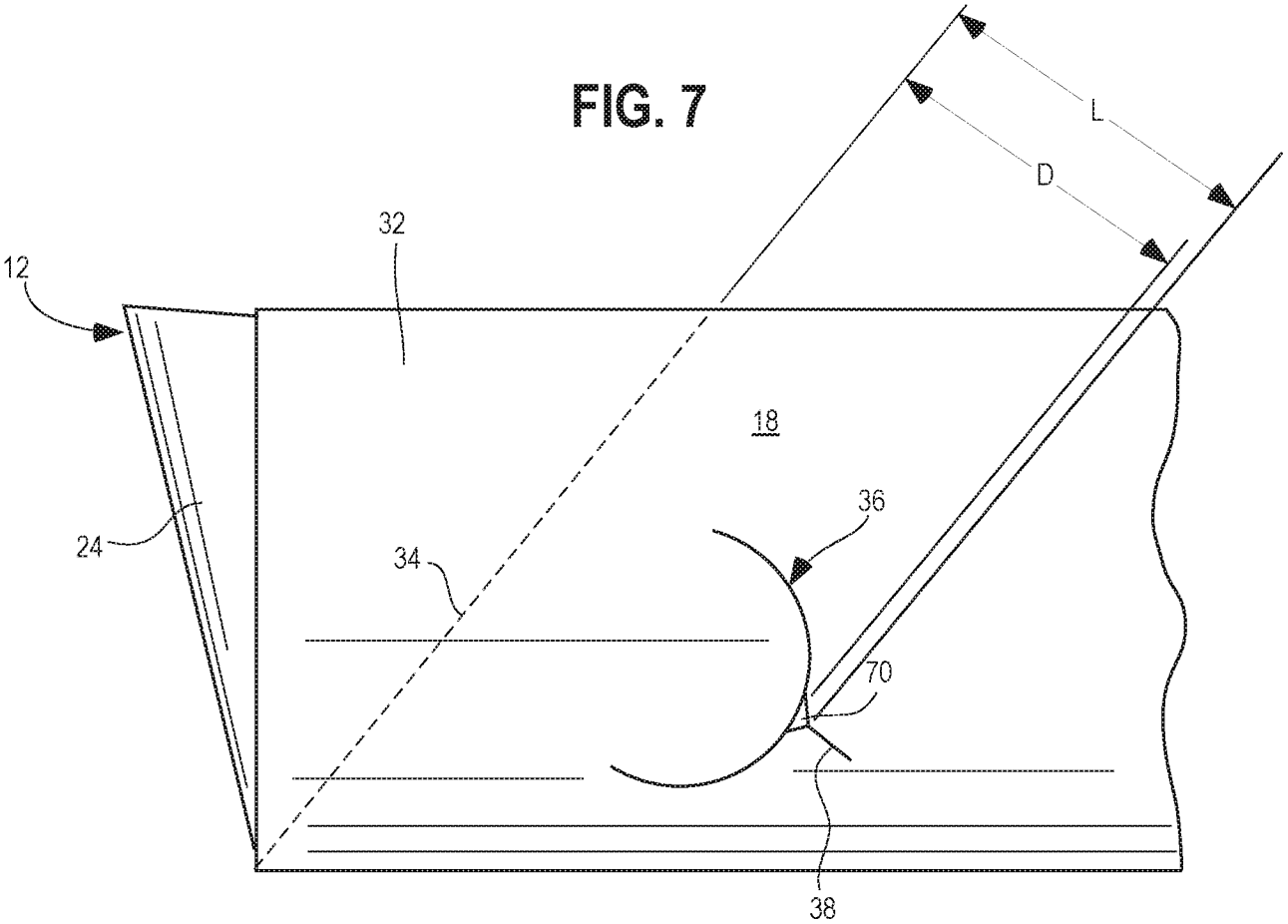
FIG. 7 is an enlarged partial side elevation view of the foldable tray of FIG. 4 illustrating the foldable tray fixed in an upright position in accordance with one embodiment of the present invention.

FIGS. 4-7 illustrate tray 10 in its upright unfolded position. As illustrated, tapered walls 12 are formed by the position of end panels 20 relative to side panels 18 and bottom panel 16 and are fixed into the tapered configuration by securing end flaps 24 to side panel fold flaps 32. The inclusion of side panel fold flaps 32 and corresponding fold lines 34 may weaken the stability of side panels 18, and concomitantly the tapered walls 12, which may move from a tapered stance greater than 90° to an upright position or even less than 90° relative to the bottom panel 16, when panels 18 and 20 are in the unfolded state and formed into the sidewall of tray 10 (as illustrated in FIG. 3B). Accordingly, to provide stability to the fold lines 34 and thus to help maintain the upright position of side panels 18 when the tray 10 is in the upright unfolded position, in one embodiment the end flaps 24 are configured to extend just beyond the position of cuts 36 to permit the lower corner 70 of each end flap 24 to be inserted through cuts 36 as illustrated in FIG. 7. As shown, corner 70 is positioned adjacent to the exterior side of side panel 18 after being inserted through cut 36. In one embodiment, insert slit 38 can facilitate (a) inserting lower corner 70 through cut 36 to stabilize the tray 10 in the upright unfolded position, and (b) removing lower corner 70 from cut 36 to enable tray 10 to be configured back into its collapsed folded position.

The tapered walls 12 of the upright unfolded tray 10 facilitates the nested stacking of the trays 10. FIG. 8 illustrates two trays 10 and 10' configured into the upright unfolded position and stacked together. As shown, the tapered walls 12 of each tray 10 and 10' allows the upper tray 10 to be nested with the lower tray 10'. This configuration can allow multiple trays 10 to be stacked and nested together, which can reduce the footprint space a stack of trays 10 occupies. As a result, multiple trays 10 can be configured into the upright position prior to use, thereby saving both time and valuable counter footprint space.

Figure 12:
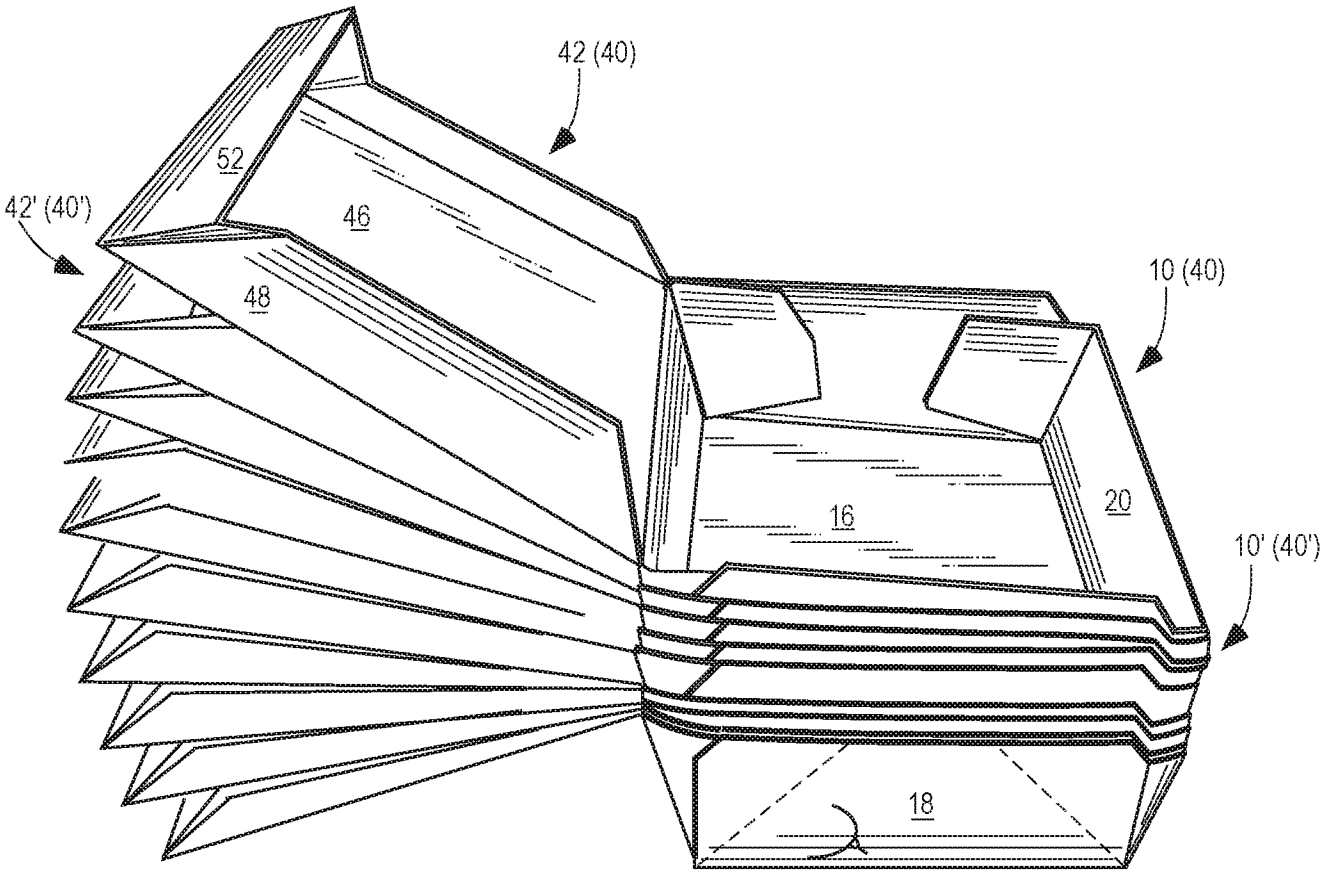
FIG. 12 is a perspective view of several foldable trays with foldable lid stacked together in accordance with one embodiment of the present invention.

The present invention is further directed toward a hinged box 40 having a lid 42 foldably connected to a base tray 10 with one or more tapered walls 12 (an embodiment of which is shown for example in FIGS. 9A and 9B), and configured to allow stacking and nesting of a plurality of hinged boxes 40 in a convenient and compact manner (as depicted e.g., in FIG. 12). Hinged box 40 can be constructed from any planar and rigid material such as paperboard, cardboard, plastic, or other like suitable material, and can be formed from a blank 44 as shown and described herein.

Figure 10:
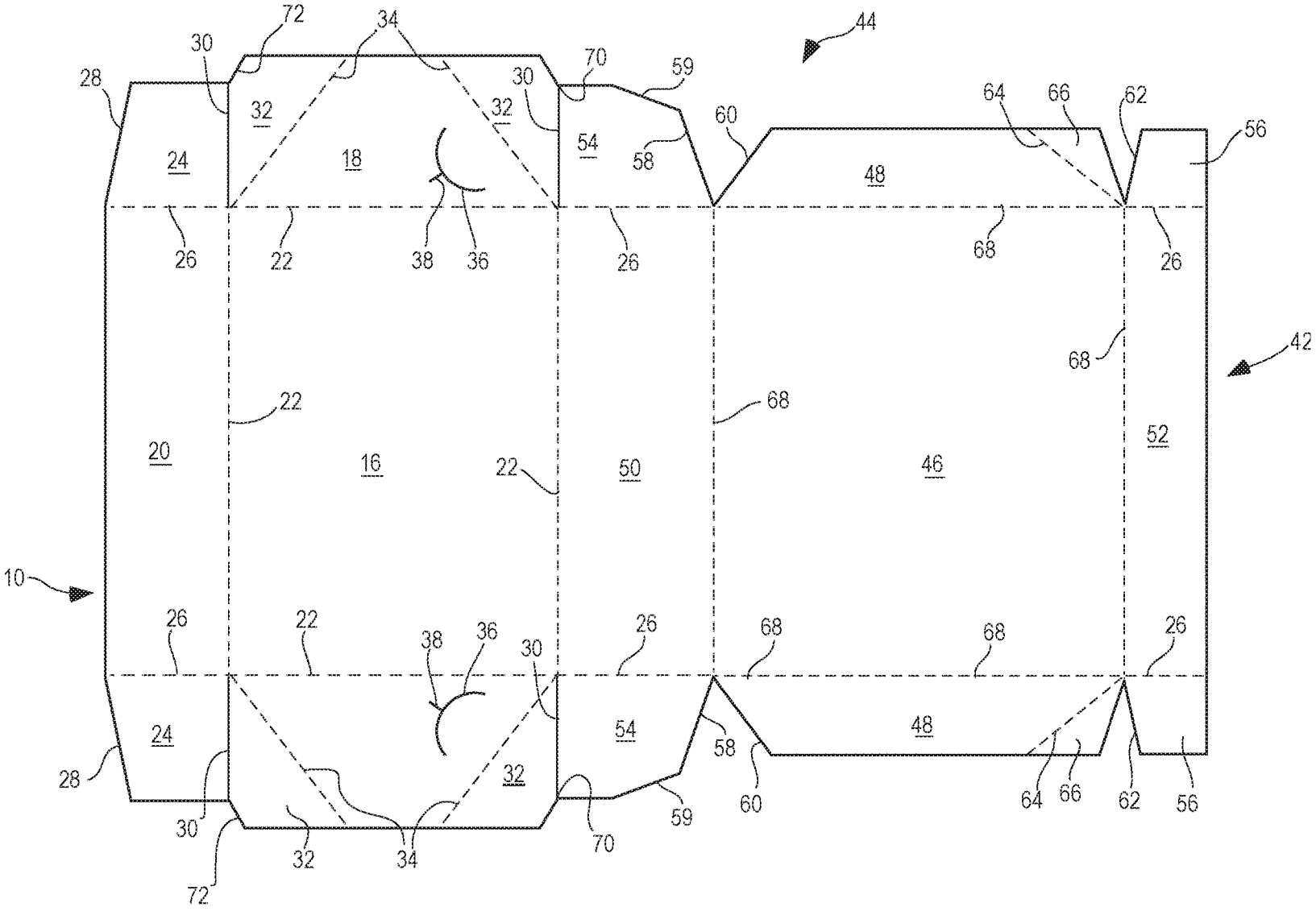
FIG. 10 is a plan view of a blank for a foldable tray with foldable lid in accordance with one embodiment of the present invention.

In one embodiment as shown in FIG. 10, hinged box 40 (and blank 44) can include a base tray 10 having a plurality of foldable panels, including a bottom panel 16, first and second side panels 18, a front end panel 20, and a back end panel 50 foldably connected to a lid 42 having a plurality of foldable panels, including a top panel 46, first and second lid side panels 48, and a lid front end panel 52.

Figure 11:
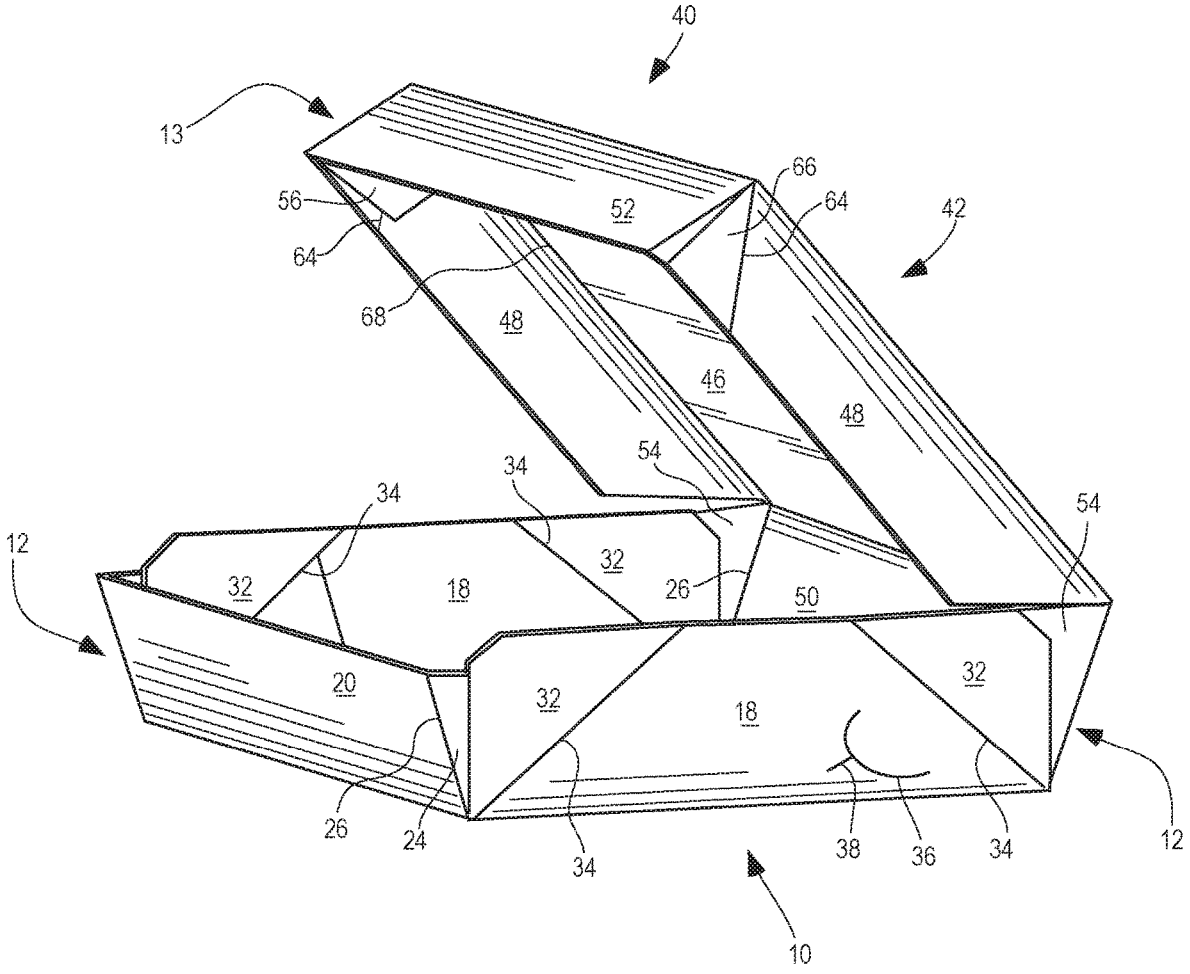
FIG. 11 is a perspective view of the foldable tray with foldable lid of FIG. 10 illustrating the foldable tray formed in an upright position from the blank, the foldable lid fully unfolded and partially lifted from the foldable tray.

Each side panel 18, tray front panel 20, and back panel 50 of the base tray 10 can be foldably connected to bottom panel 16 by a fold line 22. According to one or more embodiments, the creation of fold lines 22 can be facilitated by the use of score lines, perforated lines, or compressed lines (machine lines) along each fold line 22. Such machine lines may be may be disposed on the foldable blank during manufacturing and allow the carton to be easily folded at those locations. Tray panels 18, 20, and 50 can be connected to bottom panel 16 along each edge of bottom panel 16. For example, side panels 18 can be connected on two of the opposing edges of bottom panel 16 while end panels 20 and 50 can be connected to the two remaining opposing edges of bottom panel 16. In order to form base tray 10 from blank 44, each side panel 18 can be folded upward into a generally perpendicular orientation and each end panel 20 and 50 can be folded upward into a generally upright and outwardly tapering tapered orientation in order to form tapered walls 12 as illustrated in FIG. 11 and herein as further described.

Figure 9A:
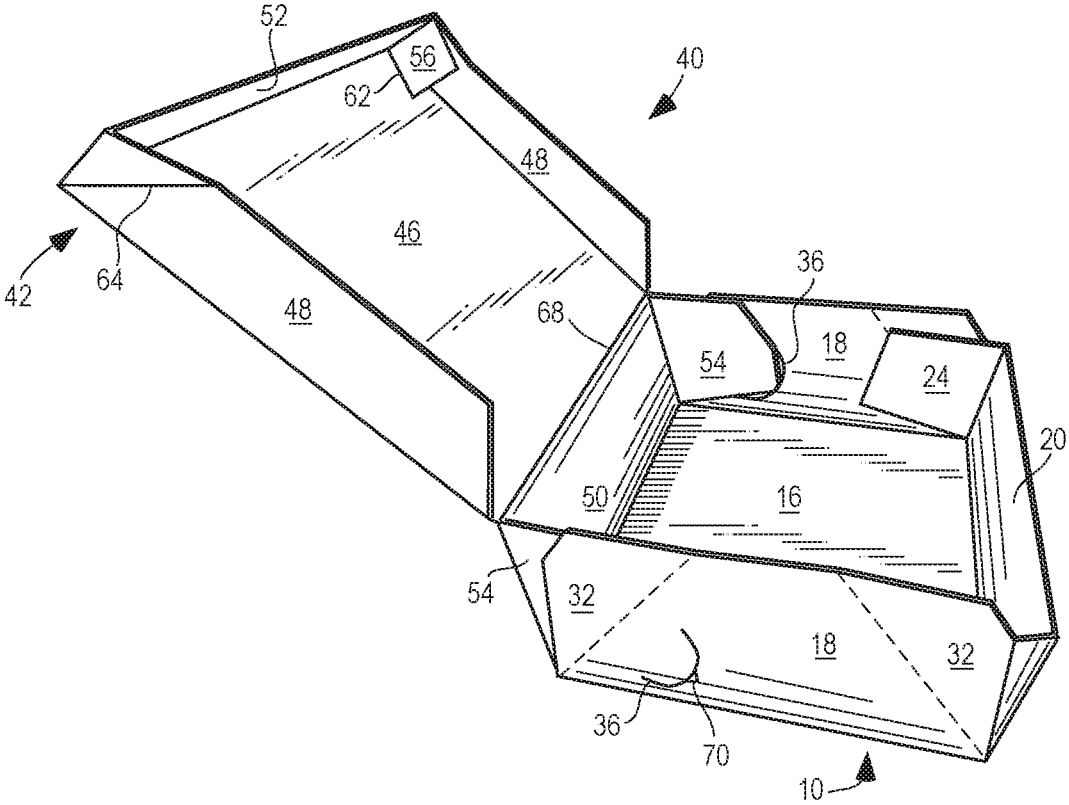
FIG. 9A is a perspective view of a foldable tray with foldable lid illustrating the foldable tray portion in an unfolded position with the foldable lid lifted and in a partially unfolded position in accordance with one embodiment of the present invention.
Figure 9B:
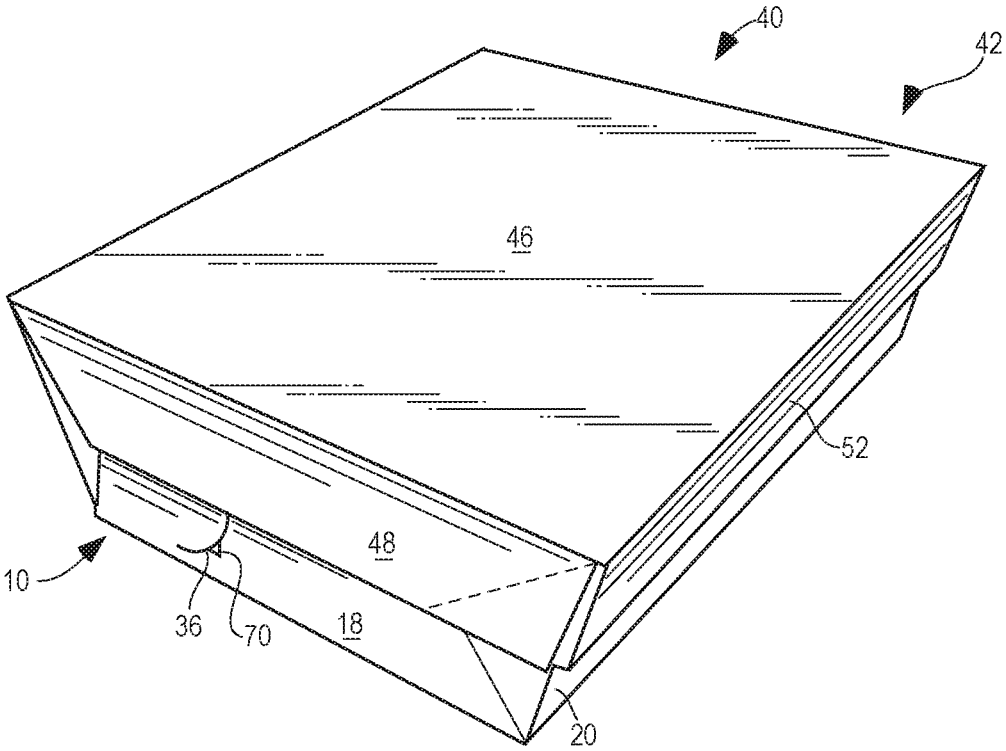
FIG. 9B is a perspective view of the foldable tray with foldable lid of FIG. 9A illustrating the foldable tray portion in an unfolded position with the foldable lid closed and in an unfolded position in accordance with one embodiment of the present invention.

As further shown in FIG. 10, in one embodiment the end panel 20 can include a pair of end flaps 24 positioned along the side edges of the end panel 20, and the end panel 50 can include a pair of end flaps 54 positioned along the side edges of the end panel 50. Each end flap 24 and 54 can be foldably connected to the side edge of front end panel 20 and back end panel 50, respectively, by a fold line 26. In one embodiment, one or more end flaps 24 can include a tapered edge 28 extending from end flap fold line 26 toward the terminal edge of end flap 24. As shown in FIG. 10, the tapered edge 28 can have a slightly angled orientation relative to the terminal edge of end panel 20. The slightly angled orientation of the tapered edge 28 can help in creating the greater than 90° fixed angle of the outward tapering tapered wall 12. End flaps 24 can also include a cut edge 30 opposite tapered edge 28. Cut edge 30 can be cut away from or otherwise disconnected from the edge of corresponding side panel 18 positioned adjacent to end flap 24, which facilitates the folding of end flaps 24 and their independent movement relative to side panel 18. In one embodiment, straight edge of end flaps 24 that are parallel to the outer edge of side panels 18 are recessed from the outer edge of side panel 18 to reveal a cut end 72. Cut end 72 facilitates the seating of lid 42 on base tray 10 when the hinged box 40 is in the unfolded upright and closed position as illustrated in FIGS. 9A and 9B.

As further shown in FIG. 10, in one embodiment, one or more end flaps 54 can include a tapered edge 58 extending from end flap fold line 26 toward the terminal edge of end flap 54. As shown in FIG. 10, the tapered edge 58 can have a slightly angled orientation relative to the terminal edge of end panel 50. The slightly angled orientation of the tapered edge 58 can help in creating the greater than 90° fixed angle of the outward tapering tapered wall 12. End flaps 54 can also include a second tapered edge 59 with a more angled orientation relative to the terminal edge of end panel 50. The more angled orientation of the tapered edge 59 can help in providing a convenient surface for adhering end flap 54 to triangular fold flap 32. End flaps 54 can also include a cut edge 30 opposite tapered edge 58. Cut edge 30 can be cut away from or otherwise disconnected from the edge of corresponding side panel 18 positioned adjacent to end flap 54, which facilitates the folding of end flaps 54 and their independent movement relative to side panels 18.

As also shown in FIG. 10, each side panel 18 can include a pair of triangular fold flaps 32 positioned along the sides of each side panel 18. As shown in FIG. 10, triangular fold flaps 32 can be formed by a fold flap fold line 34 extending in a general inward angled direction from side panel fold line 22. Fold flap fold lines 34 enable the folding of the side panels 18 and end panels 20 and 50 toward the bottom panel 16 while the assembled base tray 10 is folded. In one embodiment, each side panel 18 can further include a pair of rounded cuts 36 configured for allowing a corner 70 of a corresponding end flap 54 and/or 24 to be partially inserted therethrough when configuring base tray 10 as described below. Insertion of the corner 70 into the rounded cut 36 enables end flap 54 or 24 to provide lateral support along fold flap fold line 34 to prevent the inadvertent inward folding of the side panels 18 toward the bottom panel 16 when the base tray 10 is unfolded. In order to facilitate the partial insertion of end flap 54 through rounded cut 36, in one embodiment each rounded cut 36 can have an insert slit 38 extending away from rounded cut 36 as shown in FIG. 10.

Turning to lid 42 of the hinged box 40, each side panel 48 and lid front panel 52 of the lid 42 can be foldably connected to top panel 46 by a fold line 68. According to one or more embodiments, the creation of fold lines 68 can be facilitated by the use of score lines, perforated lines, or compressed lines (machine lines) along each fold line 68. Such machine lines may be may be disposed on the foldable blank during manufacturing and allow the carton to be easily folded at those locations. Lid panels 48 and 52, and base tray panel 50 can be connected to top panel 46 along each edge of top panel 46. For example, lid side panels 48 can be connected on two of the opposing edges of top panel 46 while lid front end panel 52 and the base tray back end panel 50 can be connected to the two remaining opposing edges of top panel 46. In order to form lid 42 from blank 44, each side panel 48 can be folded upward into a generally perpendicular orientation and front end panel 52 can be folded upward into a generally upright and inwardly tapering tapered orientation in order to form tapered wall 13 as illustrated in FIG. 11.

As further shown in FIG. 10, in one embodiment the front end panel 52 can include a pair of end flaps 56 positioned along the side edges of the end panel 52. Each end flap 56 can be foldably connected to the side edge of front end panel 52 by a fold line 26. In one embodiment, one or more end flaps 56 can include a tapered edge 62 extending from end flap fold line 26 toward the terminal edge of end flap 56. As shown in FIG. 10, the tapered edge 62 can have a angled orientation relative to the terminal edge of end panel 52. The angled orientation of the tapered edge 62 can help in creating the less than 90° fixed angle of the inwardly tapering tapered wall 13.

As also shown in FIG. 10, lid side panels 48 can include a pair of triangular fold flaps 66 positioned along the sides of each side panel 48. As shown in FIG. 10, triangular fold flaps 66 can be formed by a fold flap fold line 64 extending in a general inward angled direction from side panel fold line 68. Fold flap lines 64 enable the folding of the side panels 48 and end panel 52 toward the top panel 46 while the assembled lid 42 is folded.

In one embodiment, blank 44 can be a unitary blank and can be cut from a larger sheet or roll of material in a die-stamping process. During the production process of blank 44, one or more of fold lines 22, 26, 34, and 68 can be scored, perforated, compressed or otherwise weakened to facilitate the folding of blank 44 during the configuration of hinged box 40. In addition, end flaps 24 and 54 can be cut from side panels 18 along end flap cut edges 30 as described above.

As shown in FIGS. 9A, 9B, and 11, blank 14 can be configured into hinged box 40 by folding side panels 18 into an upright, generally perpendicular orientation (i.e., about 90°) relative to bottom panel 16 and folding end panels 20 and 50 into a generally upright and slightly tapered or angled orientation (i.e., greater than 90°) relative to bottom panel 16 in order to form tapered walls 12. In one embodiment as shown in FIG. 9A or 11, each end flap 24 and 54 of end panels 20 and 50 (respectively) can be folded inwardly adjacent to the interior of their corresponding adjacent side panel 18. Due to the tapered configuration of end panels 20 and 50 (and tapered walls 12), in one embodiment, a portion of end flaps 24 and 54 can remain visible from the exterior of hinged box 40 as illustrated in FIG. 11. The tapered edge 28 and 58 of each end flap 24 and 54, respectively, can allow each end flap 24 and 54 to remain parallel to and/or below the upper edge of the corresponding side panel 18 even though each end flap 24 and 54 are orientated at an angle relative to side panels 18 in order to facilitate the creation of tapered walls 12. The cut ends 72 of the side panels 18 further ensure that the tapered edge 58 and 28 remain at or below (but not above) the outer edge of side panels 18 to facilitate lid closure as described above. Each end flap 24 and 54 can also be secured to the adjacent side panel fold flap 32 by means of an adhesive such as e.g., a latex glue, a polyvinyl acetate glue, an epoxy, a polyurethane, a rubber cement, a cyanoacrylate adhesive, and the like; heat sealing, such as e.g., polypropylene or other polymer, wax, and the like; mechanical fixing, such as e.g., brads, rivets, pins, staples, and the like; or other suitable means. According to one embodiment of the present invention, a small bead of adhesive is applied to a portion of the interior side of side panel fold flap 32 and end flap 24 or 54 is then placed in the correct orientation to form tapered wall 12 and the exterior side of end flap 24 or 54 is secured to side panel fold flap 32.

The lid 42 portion of the hinged box 40 can be configured by folding side panels 48 into an upright, generally perpendicular orientation (i.e., about 90°) relative to top panel 46 and folding front end panel 52 into a generally upright and slightly tapered or angled orientation (i.e., less than 90°, but greater than about 30°, or greater than about 45°) relative to top panel 46 in order to form tapered wall 13. In one embodiment as shown in FIG. 9A or 11, each end flap 56 of front end panel 52 can be folded inwardly adjacent to the interior of its corresponding adjacent side panel 48. The tapered edge 62 of each end flap 56 can allow each end flap 56 to remain parallel to the planar surface of the top panel 46 (i.e., tapered edge 62 is approximately parallel to the surface of top panel 46) even though each end flap 56 is orientated at an angle relative to side panels 48 in order to facilitate the creation of tapered wall 13. Each end flap 56 can be secured to the adjacent side panel fold flap 66 to allow for sufficient frictional force between tapered edge 62 and top panel 46 surface to help maintain the lid 42 in an upright unfolded configuration. Each end flap 56 can be secured to the adjacent side panel fold flap 66 by means of an adhesive such as e.g., a latex glue, a polyvinyl acetate glue, an epoxy, a polyurethane, a rubber cement, a cyanoacrylate adhesive, and the like; heat sealing, such as e.g., polypropylene or other polymer, wax, and the like; mechanical fixing, such as e.g., brads, rivets, pins, staples, and the like; or other suitable means. According to one embodiment of the present invention, a small bead of adhesive is applied to a portion of the interior side of side panel fold flap 66 and end flap 56 is then placed in the correct orientation to form tapered wall 13 and the exterior side of end flap 56 is secured to side panel fold flap 66.

The tapered configuration of end panels 20, 50, and 52, and corresponding end flaps 24, 54, and 56 along with side panel fold flaps 32 and 66, allow hinged box 40 to transition between a upright unfolded position (as illustrated in FIG. 9B) and a collapsed folded position. In one embodiment to fold the hinged box 40 into its collapsed position, side panels 18 can be folded inwardly toward bottom panel 16. Side panel fold flaps 32 allow side panels 18 to begin to fold inwardly while end panels 20 and 50 remain generally upright, even though end flaps 24 and 54 are affixed to fold flaps 32 of side panels 18. As side panels 18 fold inwardly, side panel fold flaps 32 can fold outwardly along fold flap fold line 34 and against the exterior side of side panels 18. End flaps 24 and 54 can then fold onto the exterior side of side panels 18 and side panel fold flaps 32, and finally end panel 20 can fold onto end flaps 24, and end panel 50 can fold into end flaps 54. Side panels 48 can be folded inwardly toward top panel 46. Side panel fold flaps 66 allow side panels 48 to begin to fold inwardly while end panel 52 remains generally upright, even though end flaps 56 are affixed to fold flaps 66 of side panels 48. As side panels 48 fold inwardly, side panel fold flaps 66 can fold outwardly along fold flap fold line 64 and against the exterior side of side panels 48. End flaps 56 can then fold onto the exterior side of side panels 48 and side panel fold flaps 66, and finally end panel 52 can fold onto end flaps 56. This configuration can allow for efficient and economical shipping, transport and storage of the folded and assembled hinged box 40.

FIGS. 9A, 9B, and 11 illustrate hinged box 40 in its upright unfolded position. As illustrated, tapered walls 12 are formed by the position of end panels 20 and 50 relative to side panels 18 and bottom panel 16 and are fixed into the tapered configuration by securing end flaps 24 and 54 to side panel fold flaps 32. The inclusion of side panel fold flaps 32 and corresponding fold lines 34 may weaken the stability of side panels 18, and concomitantly the tapered walls 12, which may move from a tapered stance greater than 90° to an upright position or even less than 90° relative to the bottom panel 16, when panels 18 and 20 are in the upright unfolded state and formed into the sidewall of base tray 10 (as illustrated in FIG. 9A). Accordingly, to provide stability to the fold lines 34 and thus to help maintain the upright position of side panels 18 when the base tray 10 is in the upright unfolded position, in one embodiment the end flaps 54 are configured to extend just beyond the position of rounded cuts 36 to permit the lower corner 70 of each end flap 54 to be inserted through rounded cuts 36 as illustrated in FIGS. 9A and 9B. As shown, corner 70 is positioned adjacent to the exterior side of side panel 18 after being inserted through rounded cut 36. In one embodiment, insert slit 38 can facilitate (a) inserting lower corner 70 through rounded cut 36 to stabilize the base tray 10 in the upright unfolded position, and (b) removing lower corner 70 from rounded cut 36 to enable tray 10 to be configured back into its collapsed folded position.

In another embodiment to provide stability to the fold lines 34 and thus to help maintain the upright position of side panels 18 when the base tray 10 is in the upright unfolded position, the end flaps 24 are configured to extend just beyond the position of rounded cuts 36 to permit the lower corner 70 of each end flap 24 to be inserted through rounded cuts 36 as illustrated in FIG. 7. As shown, corner 70 is positioned adjacent to the exterior side of side panel 18 after being inserted through rounded cut 36. In one embodiment, insert slit 38 can facilitate (a) inserting lower corner 70 through rounded cut 36 to stabilize the base tray 10 in the upright unfolded position, and (b) removing lower corner 70 from rounded cut 36 to enable tray 10 to be configured back into its collapsed folded position. As best illustrated in FIG.

7, when the tray 10 is formed, the distal end 70 may include a terminal edge that extends a length L from the fold line 34 and the cut 36 may include a portion located a distance D from the fold line 34. As demonstrated, length L is greater than distance D such that at least a portion of the distal end 70 of the end flap 24 extends through the cut 36. In one embodiment, length L is between about 5% and about 20% greater than distance D, although other suitable proportional relationships between the length L and distance D are also within the scope of the present invention.

FIGS. 9A, 9B, and 11 illustrate hinged box 40 in its upright unfolded position. As illustrated in FIGS. 9A, 9B, and 11, tapered wall 13 is formed by the position of end panel 52 relative to side panels 48 and top panel 46, and is fixed into the tapered configuration by securing end flaps 56 to side panel fold flaps 66. The inclusion of side panel fold flaps 66 and corresponding fold lines 64 may weaken the stability of side panels 48, and concomitantly the tapered wall 13, which may move from a tapered stance less than 90° and greater than about 45° to an position less than 45° relative to the top panel 46, or collapsed (folded) against the top panel 46, when panel 48 is in the upright unfolded state and formed into the sidewall of lid 42 (as illustrated in FIG. 9A). Accordingly, to provide stability to the fold lines 64 and thus to help maintain the upright position of side panels 48 when the lid 42 is in the upright unfolded position and to reduce the likelihood of inadvertent folding-in of the side panels 48, in one embodiment, the end flaps 56 are configured and adhered to the fold flaps 66 to permit the bottom edge 62 of each end flap 56 to frictionally bind to the surface of top panel 46.

The tapered walls 12 of the upright unfolded tray 10 facilitates the nested stacking of the hinged boxes 40. FIG. 12 illustrates ten hinged boxes 40 with at least two base trays 10 and 10' configured into the upright unfolded position and stacked together with other hinged boxes 40. As shown, the tapered walls 12 of each base tray 10 and 10' allows the hinged box 40 to be nested with the lower hinged box 40'. This configuration can allow multiple hinged boxes 40 to be stacked and nested together, which can reduce the footprint space a stack of hinged boxes 40 occupies. As a result, multiple hinged boxes 40 can be configured into the upright position prior to use, thereby saving both time and valuable counter footprint space.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "with", "having", and "including", and similar terms as used in the foregoing specification are used in the sense of "optional" or "may include" and not as "required. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A foldable tray comprising:

a bottom panel;

a plurality of wall panels foldably connected to said bottom panel and extending upward therefrom;

at least one end flap foldably connected to an end of a first wall panel of said plurality of wall panels;

at least one cut defined in an adjacent second wall panel of said plurality of walls panels; and a fold flap formed by a fold line defined in said second wall panel;

wherein said end flap is secured to said fold flap.

2. The foldable tray of claim 1, wherein said at least one end flap is configured for partial insertion into said cut defined into said adjacent second wall panel.

3. The foldable tray of claim 2, wherein a distal end of said at least one end flap is configured to insert into said cut.

4. The foldable tray of claim 3, wherein said distal end of said at least one end flap extends past the cut at a length no less than 5% of the shortest length from the fold line of said folding corner to a tip of said distal end of said at least one end flap.

5. The foldable tray of claim 2, wherein said tray is configured for having a collapsed position where said plurality of wall panels are folded downward against said bottom panel in a flattened state and configured for having an upright position where said plurality of wall panels extend upwardly from said bottom panel and at least one wall panel has an angled orientation relative to said remaining plurality of wall panels to form a tapered profile.

6. The foldable tray of claim 1, wherein said cut includes a continuous curved cut.

7. The foldable tray of claim 6, further comprising an insert slit positioned radial to said continuous curved cut.

8. The foldable tray of claim 1, wherein at least one wall panel of said plurality of wall panels includes a tapered profile.

9. The foldable tray of claim 8, wherein said tray is configured for stacking with a second identical tray.

10. The foldable tray of claim 9, wherein said tapered profile of said wall panel having a tapered profile allows said tray to nest with said second identical tray.

11. The foldable tray of claim 1, wherein said bottom panel is a rectangle and said plurality of wall panels comprise two end panels and two side panels, and wherein said side panels are positioned parallel to one another.

12. The foldable tray of claim 11, wherein each said end panel comprises two opposing said end flaps.

13. The foldable tray of claim 12, wherein each of said end flaps is fixed to a triangular fold flap on each side panel.

14. The foldable tray of claim 13, wherein each said side panel comprises at least one said cut proximal at least one respective said end flap.

15. The foldable tray of claim 11, wherein at least one of said end panels forms said tapered profile, and wherein said tapered profile is an outward tapered profile.

16. The foldable tray of claim 1 further comprising:

a top panel foldably connected to one of said plurality of wall panels;

three top wall panels foldably connected to said top panel extending downward therefrom when said top panel is in a closed position; and at least one end flap foldably connected to an end of one of said three top wall panels;

wherein at least one top wall panel of said three top wall panels includes a tapered profile.

17. The foldable tray of claim 16, wherein said top panel is a rectangle and said three top wall panels comprise two side top wall panels and one end top wall panel, and wherein said top wall panels are positioned parallel to one another.

18. The foldable tray of claim 17, wherein said end top wall panel comprises two end flaps.

19. The foldable tray of claim 18, wherein each said end flap of said top wall panel is fixed to a triangular fold flap on each of side top wall panel.

20. The foldable tray of claim 19, wherein said end top wall panel includes a tapered profile.

21. The foldable tray of claim 20, wherein said tapered profile of said end top wall panel is an inward tapered profile.

22. A foldable unitary blank for formation into a tray, said blank comprising:

a bottom panel;

two side panels, each connected to said bottom panel by a side panel fold line;

two end panels, each connected to said bottom panel by an end panel fold line;

an end flap foldably connected to a side of one of said end panels;

a fold flap formed by a fold line defined in one of said side panels; and a cut defined through one of said side panels positioned adjacent to said end flap;

wherein said cut is configured to receiving a lower corner of said end flap when said blank is folded into said tray; wherein said tray includes a tapered wall facilitated by said end flaps insertion through said cut and wherein said end flap is configured to be secured to said fold flap.

23. The foldable unitary blank of claim 22, wherein said tapered wall of said tray tapers outwardly when the blank is formed into a tray.

24. The foldable unitary blank of claim 22 further comprising:

a top panel connected to one of said two end panels by a top panel fold line;

two additional side panels, each connected to said top panel by a side panel fold line;

one additional end panel connected to said top panel by an end panel fold line;

two end flaps foldably connected to each end of said additional end panel;

wherein each end flap foldably connected to a side of said additional end panel includes a tapered edge configured to frictionally meet the top panel when said blank is folded into a lid of said tray; wherein said lid includes a tapered wall facilitated by said tapered edge meeting the top panel.

25. The foldable unitary blank of claim 24, wherein said tapered wall of said lid tapers inwardly.

26. A foldable tray comprising:

(a) a base tray including:

(i) a bottom panel, and (ii) a plurality of bottom wall panels foldably connected to said bottom panel and extending upward therefrom, wherein at least one of said plurality of bottom wall panels tapers outwardly;

at least one end flap foldably connected to an end of a first wall panel of said plurality of bottom wall panels;

a fold flap formed by a fold line defined in a second wall panel of said plurality of wall panels; and at least one cut defined in said second wall panel of said plurality of wall panels;

wherein said end flap is secured to said fold flap; and (b) a lid including:

(i) a top panel foldably connected to one of said plurality of bottom wall panels (a)(ii); and (ii) three top wall panels foldably connected to said top panel extending downward therefrom, wherein at least one of said plurality of top wall panels tapers inwardly, and wherein said inwardly tapering top wall panel overlaps said outwardly tapering bottom wall when said lid is in a closed configuration.

* * * * *